US006688592B1

(12) United States Patent
Tan et al.

(10) Patent No.: US 6,688,592 B1
(45) Date of Patent: Feb. 10, 2004

(54) PAPER TRAY FOR A PRINTING MECHANISM

(75) Inventors: Wee Lian Tan, Singapore (SG); Pui Wen Huang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/209,564

(22) Filed: Jul. 30, 2002

(51) Int. Cl.[7] ..... B65H 1/00
(52) U.S. Cl. ..... 271/171
(58) Field of Search ..... 271/171

(56) References Cited

U.S. PATENT DOCUMENTS

| | | | | | |
|---|---|---|---|---|---|
| 5,172,903 | A | * | 12/1992 | Haneda et al. | 271/171 |
| 5,297,787 | A | * | 3/1994 | Shirai | 271/171 |
| 5,647,585 | A | * | 7/1997 | Cheong | 271/171 |
| 5,901,952 | A | * | 5/1999 | Hourtash | 271/171 |
| 6,196,539 | B1 | * | 3/2001 | Lee | 271/171 |

FOREIGN PATENT DOCUMENTS

| | | | | | |
|---|---|---|---|---|---|
| JP | 63196458 | A | * | 8/1988 | B65H/31/20 |
| JP | 04350025 | A | * | 12/1992 | B65H/1/04 |
| JP | 06016247 | A | * | 1/1994 | B65H/1/04 |

* cited by examiner

*Primary Examiner*—Donald P. Walsh
*Assistant Examiner*—Kaitlin Joerger

(57) ABSTRACT

A tray for holding a stack of media sheets for feeding into a printing mechanism is provided. The tray has a first media guide movable relative to a first wall of the tray in a first direction to vary a first spacing therebetween for accommodating different media sizes in the first direction. The tray also has a second media guide manually adjustable relative to a second wall of the tray in a second direction to vary a second spacing therebetween for accommodating different media sizes in the second direction. The second direction is substantially perpendicular to the first direction. Furthermore, the movements of the first guide are synchronized with movements of the second guide so that adjustment of the first guide is automatically achieved through the manual adjustment of the second guide.

1 Claim, 5 Drawing Sheets

PAPER TRAY FOR A PRINTING MECHANISM

BACKGROUND

This invention relates to a tray for holding a stack of media sheets for feeding into a printing mechanism. For convenience, the term "paper" throughout this specification is to be understood as encompassing all forms of print media including but not limited to paper, plastic transparency sheets, vellum, and the like which are storable in a tray for feeding into a printing mechanism.

Certain types of paper trays associated with printing mechanisms normally have at least a pair of paper guides for accommodating different paper widths and lengths. Each paper guide is slidably mounted on the tray for movements relative to a respective wall of the tray to vary the spacing between the paper guide and its respective wall. Conventionally, each paper guide has to be adjusted individually. This may not be convenient in that normally papers of different sizes have different widths and lengths. Thus, for a user of a printing mechanism using the conventional paper tray, the user has to adjust both paper guides when different sized papers are loaded. This may not be desirable, especially if one of the paper guides is not easily accessible due to the design of the paper tray. Furthermore, when the user fails to adjust one of the paper guides correctly, paper skew is likely to occur during the subsequent picking process, and consequently printing quality may be affected.

Therefore, there is a need for an improved paper tray, which allows easier adjustments of its paper guides.

SUMMARY

According to an aspect of the present invention, there is provided a tray for holding a stack of media sheets for feeding into a printing mechanism. The tray has a first media guide movable relative to a first wall of the tray in a first direction to vary a first spacing therebetween for accommodating different media sizes in the first direction. The tray also has a second media guide manually adjustable relative to a second wall of the tray in a second direction to vary a second spacing therebetween for accommodating different media sizes in the second direction. The second direction is substantially perpendicular to the first direction. Furthermore, the movements of the first guide are synchronized with movements of the second guide so that adjustment of the first guide is automatically achieved through the manual adjustment of the second guide.

Other aspects and advantages of the invention will become apparent from the following detailed description in conjunction with the accompanying drawings; the description illustrates by way of example the principles of the invention.

DETAILED DESCRIPTION

Figure 1:
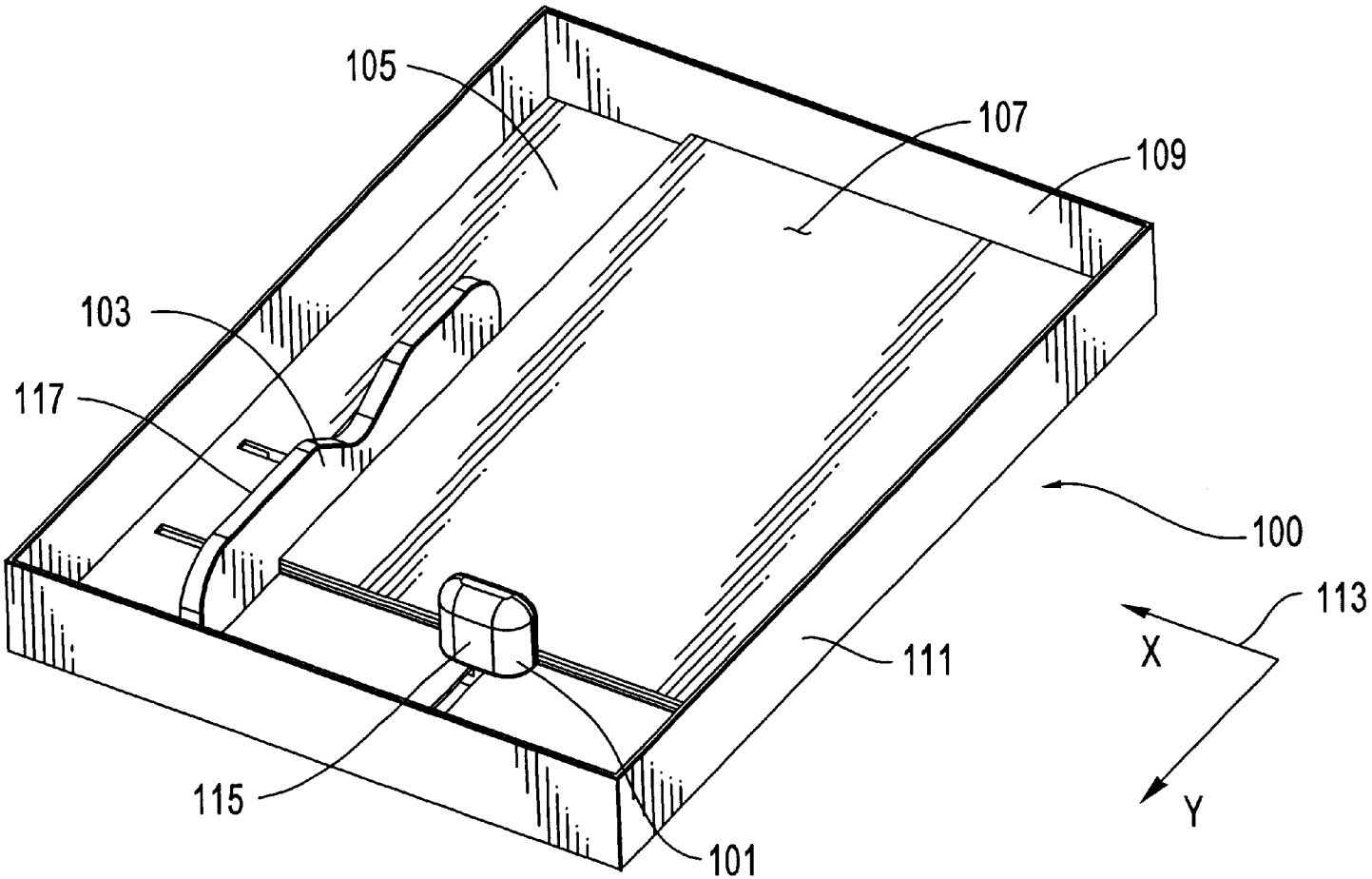
FIG. 1 is a perspective view of an embodiment of a paper tray having a pair of paper guides according to the invention.

In FIG. 1, an exemplary paper tray 100 has a bottom support 105, at least a front wall 109 and a side wall 111 projecting upward from the bottom support 105. The paper tray 100 also provide a paper length guide 101 slidable relative to the front wall 109 opposite it along a Y axis as shown by the XY coordination axis 113 and a paper width guide 103 slidable relative to the side wall 111 opposite it along an X axis, which is substantially perpendicular to the Y axis. Furthermore, each paper guide 101, 103 has a projection 115, 117 projecting upwards and each is substantially parallel to its respective opposite wall 109, 111. The region bound by the projections of the slidable paper guides 115, 117 and the respective walls 109, 111 defines an area for receiving a stack of sheets of paper 107, which is supported on the surface of bottom support 105 and maintained in position by the walls 109, 111 and the projections of the slidable paper guides 101, 103. When a stack of different sized paper are used, the paper guides 101, 103 can be adjusted to appropriate positions to accommodate the different sized papers.

In the exemplary embodiment of the invention, movements of the paper width guide 103 is synchronized with the movements of the paper length guide 101. In this way, adjustments of the paper length guide 101 automatically adjust the position of the paper width guide 103.

Figure 2:
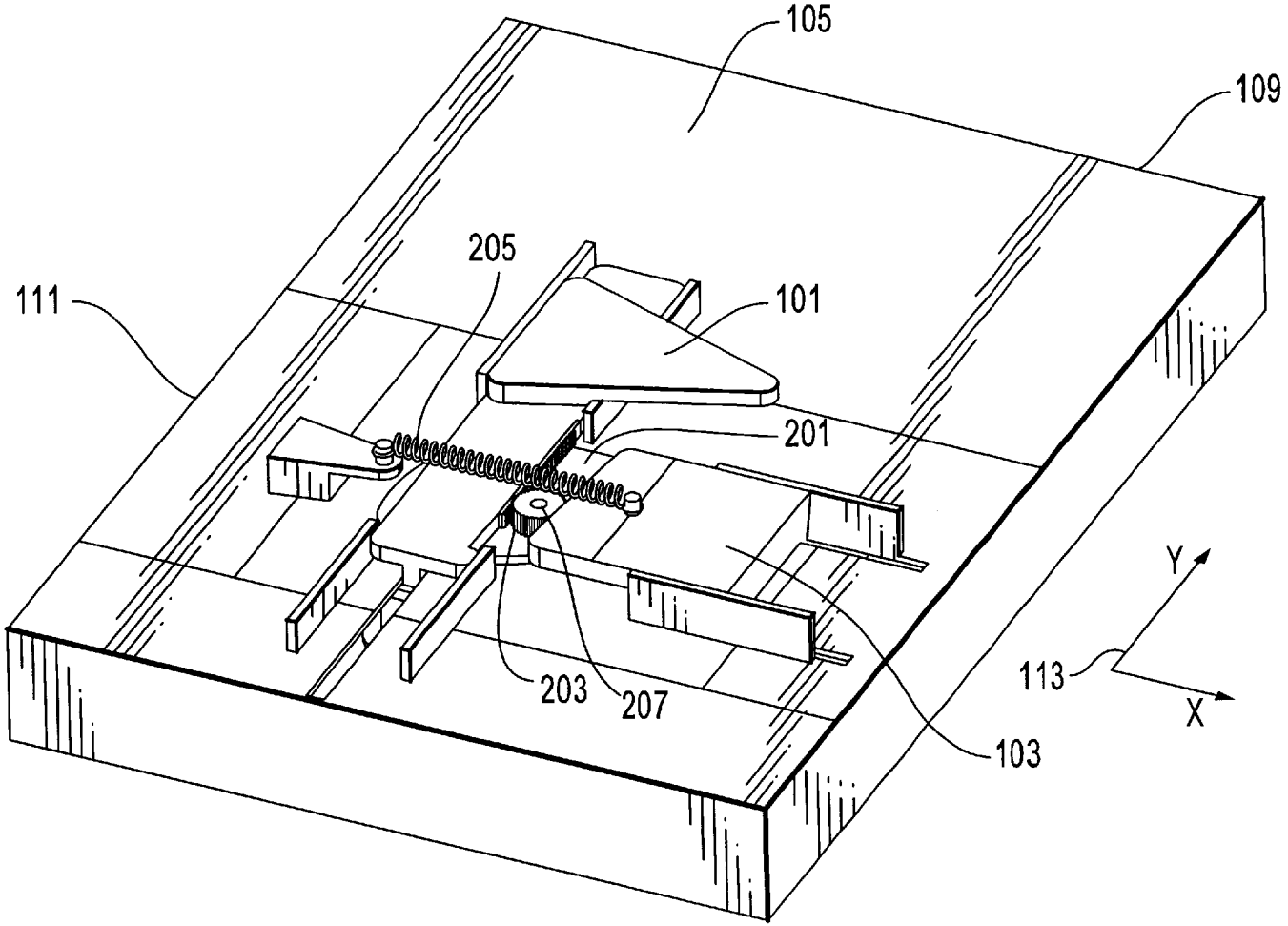
FIG. 2 is a bottom view of the tray of FIG. 1, illustrating a mechanism for synchronizing movements of the paper guides.
Figure 3:
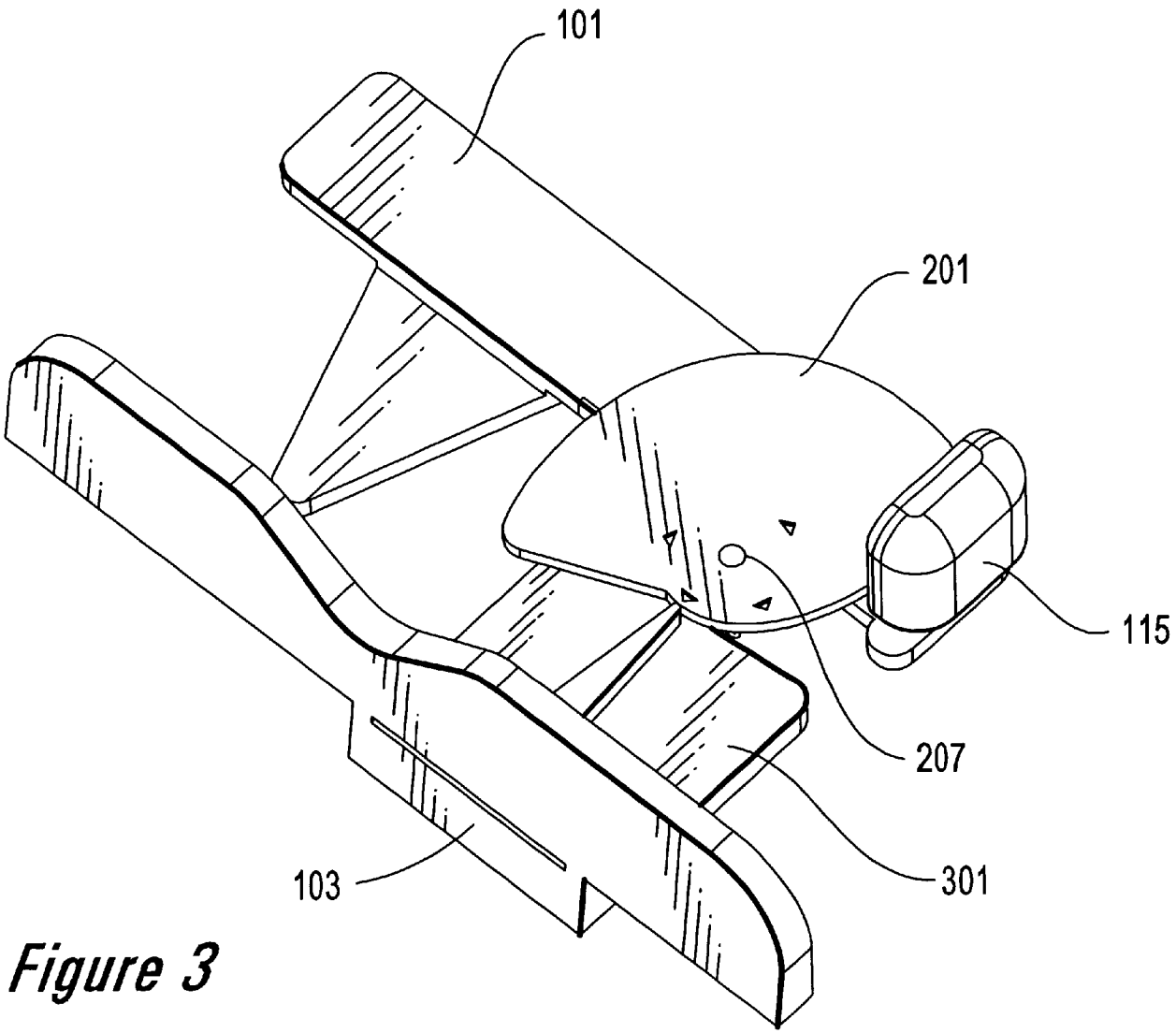
FIG. 3 is a perspective view of a portion of the tray of FIG. 2, illustrating operation of the paper guides.

Shown in FIGS. 2 and 3 is the mechanism for synchronizing the movements of the paper width guide 103 with the paper length guide 101. A gear 203 mounted to a gear shaft 207, which is rotatably mounted to the bottom support 105, is positioned under the bottom support and is interactable with the paper length guide so that linear movements of the paper length guide along Y axis can be transformed into the rotational movements of the gear 203. Furthermore, a spring 205 substantially parallel to the X axis is also positioned under the bottom support 105, with one of its ends mounted to the bottom support 105 while the other end mounted to the paper width guide 103.

Thereby, the spring 205 biases the paper width guide 103 towards the side wall 111 so that a portion of paper width guide 301 is always in contact with a cam 201, which has a predefined profile and is positioned between the gear 203 and the bottom support 105. The cam 201 is also mounted to the gear shaft 207 so that it rotates together with the gear 203.

Therefore, when the paper length guide 101 is manually slid relative to the front wall 109 along Y axis, the linear movements of the paper length guide 101 is transformed into the rotational movements of the gear 203 and consequently into the rotational movements of the cam 201. Since the paper width guide 103 is always held in contact with the cam 201, the cam profile determines the position of the paper width guide 103 relative the side wall 111 along Y axis. In this way, automatic adjustment of the paper width guide is achieved.

Figure 4:
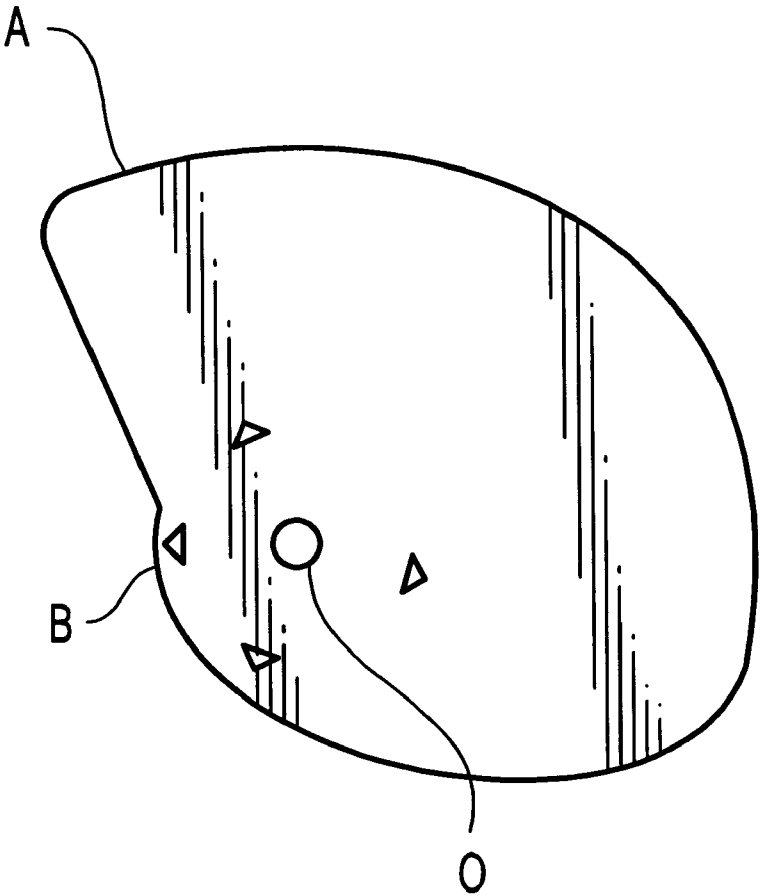
FIG. 4 is a top view of a portion of the synchronizing mechanism of FIG. 2.

Positioning of the paper width guide is achieved through the orientation of the cam and the design of the cam profile. The cam 201 is designed so that when the paper length guide 101 moves to a desired position for accommodating a certain type of papers, the cam 201 is in contact with the paper width guide 103 at a pre-selected contacting point A, B (see FIG. 4) along its profile. By predetermining the spacing between the contacting point and the center of the gear shaft O (see FIG. 4), the position of the paper width guide relative to the side wall along X axis is then predetermined.

For example, the spacing between contacting point B and center O is designed so that the paper width guide can accommodate the width of B5 paper when it is in contact with the cam at point B. On the other hand, the spacing between contacting point A and center O is designed so that the paper width guide can accommodate the width of A4 paper when it is in contact with the cam at point A. Furthermore, contacting points A, B are spaced along the cam profile so that when the paper length guide moves from a position that accommodates the length of B5 paper to a position that accommodates the length of A4 paper, the cam is rotated to change its contacting point with the paper width guide from point B to point A. In this way, adjustment of the paper width guide is automatically achieved. In addition, as for two types of paper having different lengths but the same width, two contacting points spaced from center O at a same spacing can be provided along the cam profile and each corresponds to one of these two types of paper. Since these two points are spaced from center O at the same spacing, when the paper length guide moves from a position that accommodates the length of one type of paper to a position that accommodates the length of the other type of paper, the position of the paper width guide is not changed after such an adjustment.

Figure 5:
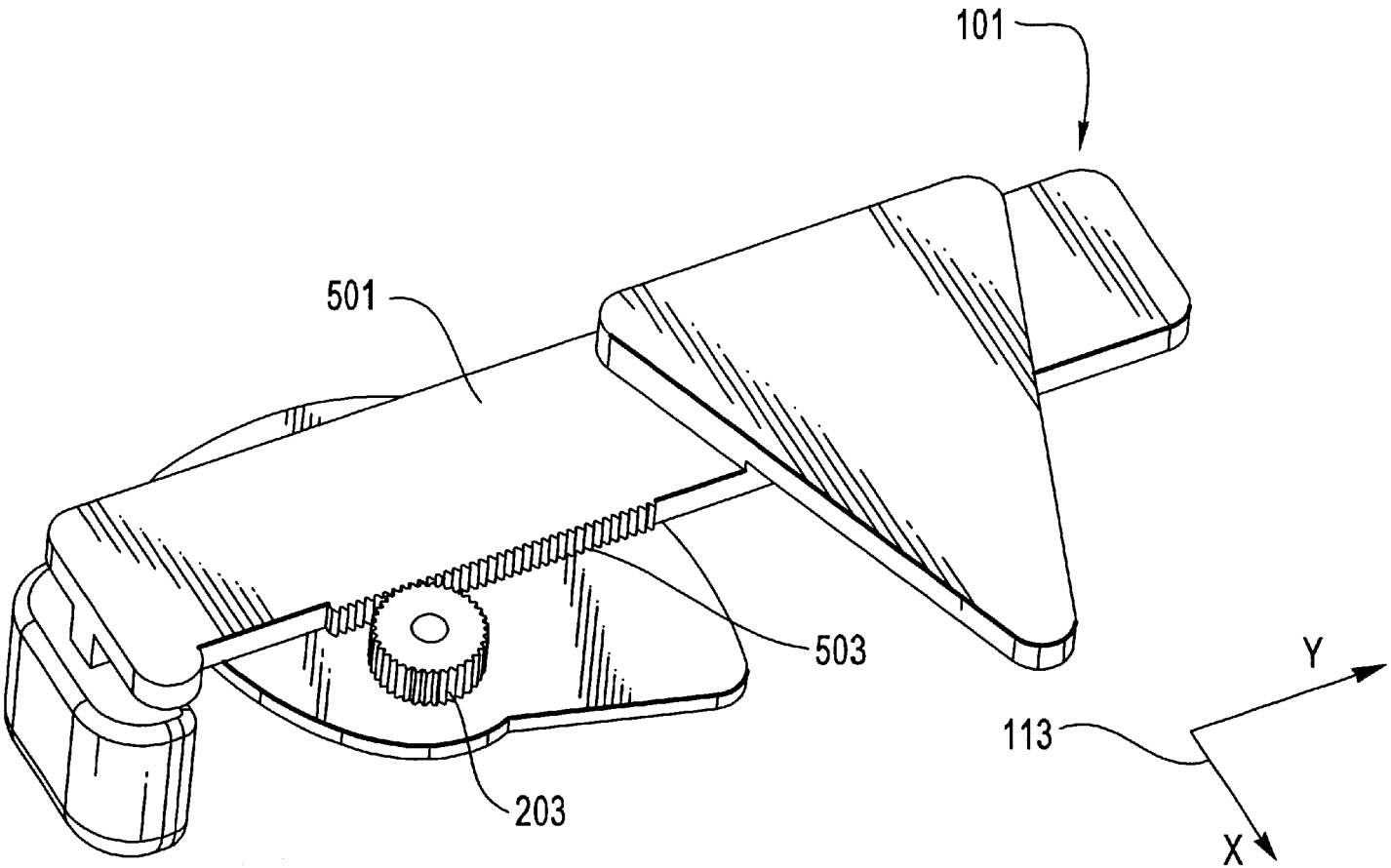
FIG. 5 is a close up view of a portion of one of the paper guide.

In FIG. 5, the paper length guide 101 has a substantially straight portion 501 extending along the Y axis. A plurality of finely spaced engaging teeth 503 are provided at one side of the straight portion 501. These engaging teeth engage with the gear 203 for transforming the linear movements of the paper length guide 101 into the rotational movements of the gear 203.

What is claimed is:

1. A printer feeder tray comprising:

a first media guide movable relative to a first wall of the tray in a first direction to vary a first spacing there between for accommodating different media sizes in the first direction, a second media guide manually adjustable relative to a second wall of the tray in a second direction substantially perpendicular to the first direction to vary a second spacing there between for accommodating different media sizes in the second direction;

means for synchronizing movements of the first guide with movements of the second guide so that, adjustment of the first guide is automatically achieved through the manual adjustment of the second guide, said synchronizing means including:

a rotatable gear interactable with the second guide for transforming linear movements of the second guide in the second direction into rotational movements of the gear, wherein the rotational movements of the gear are further transformed into linear movements of the first guide in the first direction, which is substantially perpendicular to the second direction, and a cam coupled to the first guide, wherein the cam is driven by the gear for transforming the rotational movements of the gear into the linear movements of the first guide, and wherein the cam has a predefined profile for positioning the first guide relative to the first wall; and means for biasing the first media guide towards the first wall so that the first media guide is held in contact with the profile of the cam.

* * * * *